US005351598A

United States Patent [19]

Schuetz

[11] Patent Number: 5,351,598

[45] Date of Patent: Oct. 4, 1994

[54] GAS-OPERATED RIFLE SYSTEM

[75] Inventor: Robert C. E. Schuetz, Olympia, Wash.

[73] Assignee: Olympic Arms, Inc., Olympia, Wash.

[21] Appl. No.: 938,005

[22] Filed: Aug. 28, 1992

[51] Int. Cl.[5] ..... F41A 5/26; F41A 15/16

[52] U.S. Cl. ..... 89/185; 89/128; 89/191.01; 42/71.01; 42/25

[58] Field of Search ..... 89/185, 191.01, 128; 42/71.01, 72, 73, 49.02

[56] References Cited

U.S. PATENT DOCUMENTS

| | | | |
|---|---|---|---|
| 696,306 | 3/1902 | Benet et al. | 89/185 |
| 2,116,141 | 5/1938 | Browning | 89/193 |
| 2,498,749 | 2/1950 | Benson | 42/71.01 |
| 2,951,424 | 9/1960 | Stoner | 89/191 |
| 3,198,076 | 8/1965 | Stoner | 89/128 |
| 3,618,457 | 11/1971 | Miller | 89/185 |
| 3,675,534 | 7/1972 | Baretta | 89/185 |
| 4,069,608 | 1/1978 | Jurek | 42/49.02 |
| 4,244,273 | 1/1981 | Langendorfer et al. | 89/193 |
| 4,358,986 | 11/1982 | Giorgio | 89/142 |
| 4,475,438 | 10/1984 | Sullivan | 89/184 |
| 4,765,224 | 8/1988 | Morris | 89/191.01 |
| 5,272,956 | 12/1993 | Hudson | 89/128 |

FOREIGN PATENT DOCUMENTS

| | | | |
|---|---|---|---|
| 247195 | 5/1966 | Austria | 89/191.01 |

OTHER PUBLICATIONS

Wallack, L. R., American Pistol & Revolver Design and Performance, 1978, pp. 105–107.

Chinn, George M., The Machine Gun, vol. IV, Parts X and XI, 1955, pp. 126–131, 167–168.

*Primary Examiner*—Stephen C. Bentley

*Attorney, Agent, or Firm*—Michael J. Caddell

[57] ABSTRACT

An M16 type rifle is disclosed having a gas piston assembly with a relatively large piston area and sufficient stroke to actuate the M16 bolt carrier assembly in order to allow the M16 rifle to be chambered for short low-pressure pistol cartridges such as the 45 ACP, 10 mm, and 40 S&W. The gas piston assembly provides relatively constant contact between the piston rod and the gas carrier key of the conventional M16 bolt carrier assembly.

8 Claims, 4 Drawing Sheets

GAS-OPERATED RIFLE SYSTEM

BACKGROUND OF THE INVENTION

The present invention is directed to the field of firearms and more particularly involves an automatic/semi-automatic hand-held rifle of the type exemplified by the U.S. military M16.

The M-16 automatic rifle and the AR15 semi-automatic rifle have been the standard issue weapons of the U.S. military and civilian police departments for decades. The rifle design was originated by E. M. Stoner and developed by Fairchild Engine and Airplane Company in the 1950's. Modified versions of the M16 designated as the M16A1 and M16A2 are currently in use by armed forces in the U.S. and throughout the world. A civilian semi-automatic version of the M16 designated as the AR15 is sold to civilians by Olympic Arms of Olympia, Wash. When used herein, the phrase "M16" is intended to include all versions of the M16 and AR15 previously and currently being produced.

One of the basic patents on gas-operated firearms was that granted to Browning in 1938, U.S. Pat. No. 2,116,141, which was a divisional application of U.S. Pat. No. 2,093,705. These patents disclose a piston tube assembly for disengaging the barrel from the casing of the gun.

U.S. Pat. No. 2,951,424 issued to E. M. Stoner on Sep. 6, 1960, discloses the M16 bolt and bolt carrier system and the gas operation thereof. This patent discloses a rifle utilizing a gas tube that extends from gas ports in the barrel, back into the receiver of the rifle and into a gas tube pocket or "key" attached to the bolt carrier.

U.S. Pat. No. 3,198,076 to E. M. Stoner, issued Aug. 3, 1965, discloses a gas operated, magazine-fed rifle that can be readily converted to a belt-fed machine gun by inverting the barrel assembly.

U.S. Pat. No. 3,675,534, issued to P. C. Beretta on Jul. 11, 1972, discloses a gas-operated automatic rifle having a piston and stem inside a gas tube with the stem fixedly attached to the bolt carrier.

U.S. Pat. No. 4,358,986, issued to C. Giorgio on Nov. 16, 1982, discloses a gas-operated automatic rifle having a stationary piston and a segmented movable gas cylinder/operating rod assembly including a biasing spring.

U.S. Pat. No. 3,618,457, issued to A. Miller on Nov. 9, 1971, discloses a gas-operated rifle utilizing a gas-operated piston and rod assembly with the piston rod telescopically mounted over a stationary guide rod and being spring-biased.

U.S. Pat. No. 4,765,224, issued Aug. 23, 1988, to M. Morris discloses a modified M16 type of rifle utilizing an extended gas tube receiver on the bolt carrier which maintains telescopic engagement with the gas tube at all times during the firing cycle.

U.S. Pat. No. 4,475,438 to L. Sullivan, issued on Oct. 9, 1984, discloses an open-bolt gas-operated rifle with a short-stroke piston that kicks open the bolt carrier against a biasing spring, using a short-stroke piston movement.

While the aforementioned gas-operated rifles all disclose various means of actuating a bolt in an an automatic or semi-automatic rifle, none of these teaches a design for an M16 type of rifle that allows the rifle to be chambered for short pistol-type cartridges such as the 10 mm cartridge and the 45 caliber ACP cartridge. There is insufficient gas generated in the short fat pistol cartridge to fully activate the bolt carriers in these designs. Normal operating gas pressures generated with most rifle cartridges are in the 50,000 to 55,000 CUP range, whereas in the short wide pistol cartidges the pressures generated are in the 40,000 CUP range.

Because of these low pressures, automatic and semi-automatic weapons designed for short pistol cartridges normally utilize the "blowback" type of operation wherein the rearward force on the cartridge case from the burning propellant charge therein is utilized to drive the bolt backward in the receiver in order to eject the spent cartridge and chamber another live round.

The disadvantage of blowback type of operation is the gas backblast from the chamber area that tends to hit the operator in the face and cause discomfort and inaccuracy. Also, in situations such as military and police operations it is essential to be able to place suppressors or silencers on the muzzles of the weapons to suppress the retort from firing. Suppressors and silencers are ineffective on blowback types of weapons because of the sound escaping through the breech upon blowback of the bolt. Thus, a gas-operated weapon is required when suppressed firing is desired.

Another disadvantage of the blowback system is the problem of cartridge separation. If you have a weakened cartridge or one with a thin spot in the wall, or if you have an overloaded cartridge or one with higher than normal gas pressures, because of the nature of the blowback system the cartridge will separate, blow apart, or rupture. This is due to the combination of the cartridge defect or the higher gas pressure, plus the fact that the bolt in a blowback system does not lock-up in the breech.

When a cartridge does blow apart, separate, or rupture in a blowback system it creates a dangerous situation for the operator of the rifle and anyone standing near the rifle since gas and particles of the cartridge will be expelled backward and outward from the chamber. Another problem is in removing the upper end of the cartridge from the chamber since there is no rimmed end left for the extractor to grip nor any part of the cartridge projecting out of the chamber to be manually gripped and removed. A difficult and lengthy operation utilizing a broken cartridge extractor is required.

Also, in a fully automatic weapon or in a semi-automatic weapon being fired rapidly, the broken cartridge in the chamber will cause a bad and potentially dangerous jam when the next live round is attempted to be loaded.

One disadvantage of the gas-operated M16 currently being manufactured is the fouling of the gas ports in the bolt carrier and the gas rings on the piston end of the bolt. A large amount of residue from the burning powder collects in these small and rather tortured ports and grooves. Also, dirt and moisture from the atmosphere are mixed with the gas from the burning powder in the gas system and residuals are formed in the ports, and in the gas rings on the bolt, which eventually clog and jam the weapon. Gas exiting the ports from the bolt also mix with dirt and moisture and cause deposits between the bolt, the chamber, and the receiver, thereby interfering with proper operation of the bolt and bolt carrier in the receiver.

SUMMARY OF THE INVENTION

The present invention overcomes the disadvantages of the above-described prior art rifles by providing an M16 type of rifle that is gas-operated, utilizing a piston/cylinder operation, and which is fully capable of chambering popular military and police pistol cartridges in semi-automatic and full auto configurations.

DESCRIPTION OF THE PREFERRED EMBODIMENTS

Figure 1:
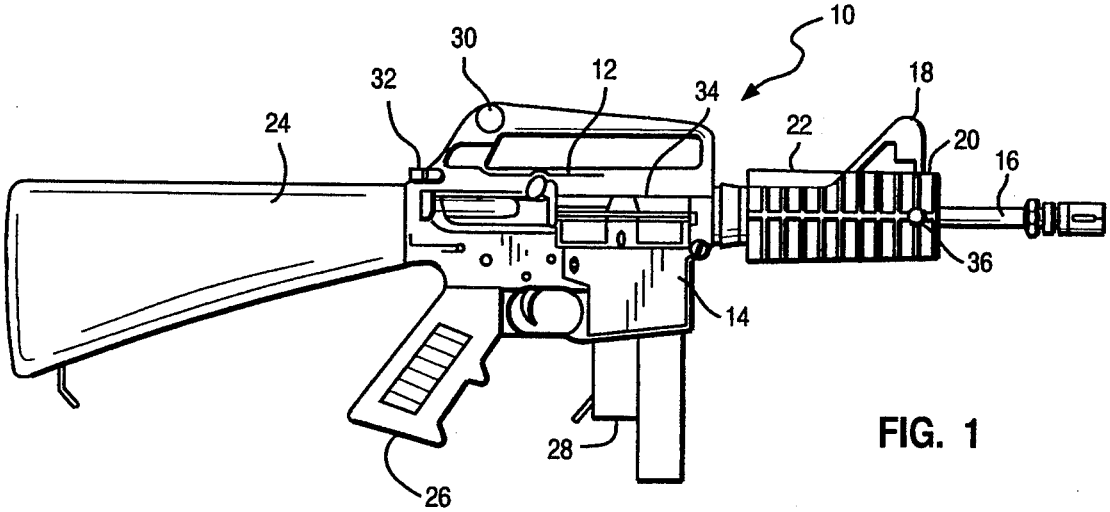
FIG. 1 is a side elevational view of an M16 type of rifle embodying the present invention.

Referring now to FIG. 1, which is a side view of an M16 type rifle manufactured according to the present invention, a rifle 10 consists of an upper receiver 12 pivotally attached to a lower receiver 14 and having a barrel 16 threadedly engaged in the upper receiver 12. Barrel 16 has a front sight assembly 18 securedly attached thereto and is partially enclosed by a pivotable handguard assembly 20. Barrel 16 has a gas port (not shown) passing through the top portion of the barrel from the bore up through the front sight assembly 18 to communicate with a gas cylinder assembly 22 lying above and substantially parallel to the barrel.

The upper and lower receivers 12 and 14 respectively, are braced by the buttstock assembly 24, which is threadedly attached to the lower receiver 14 and contains a conventional M16 buffer spring assembly 25 therein. A handgrip 26 is attached to the lower receiver directly behind the trigger assembly. A removable magazine 28 fits in the magazine well of lower receiver 14 and provides a cartridge feeding assembly. A rear sight assembly 30 is adjustably mounted in upper receiver 12. A charging handle 32 is slidably located in upper receiver 12 and also slidably engages bolt assembly 34. The handguard assembly 20 is pivotally mounted to the barrel 16 at pivot pin 36.

Figure 2:
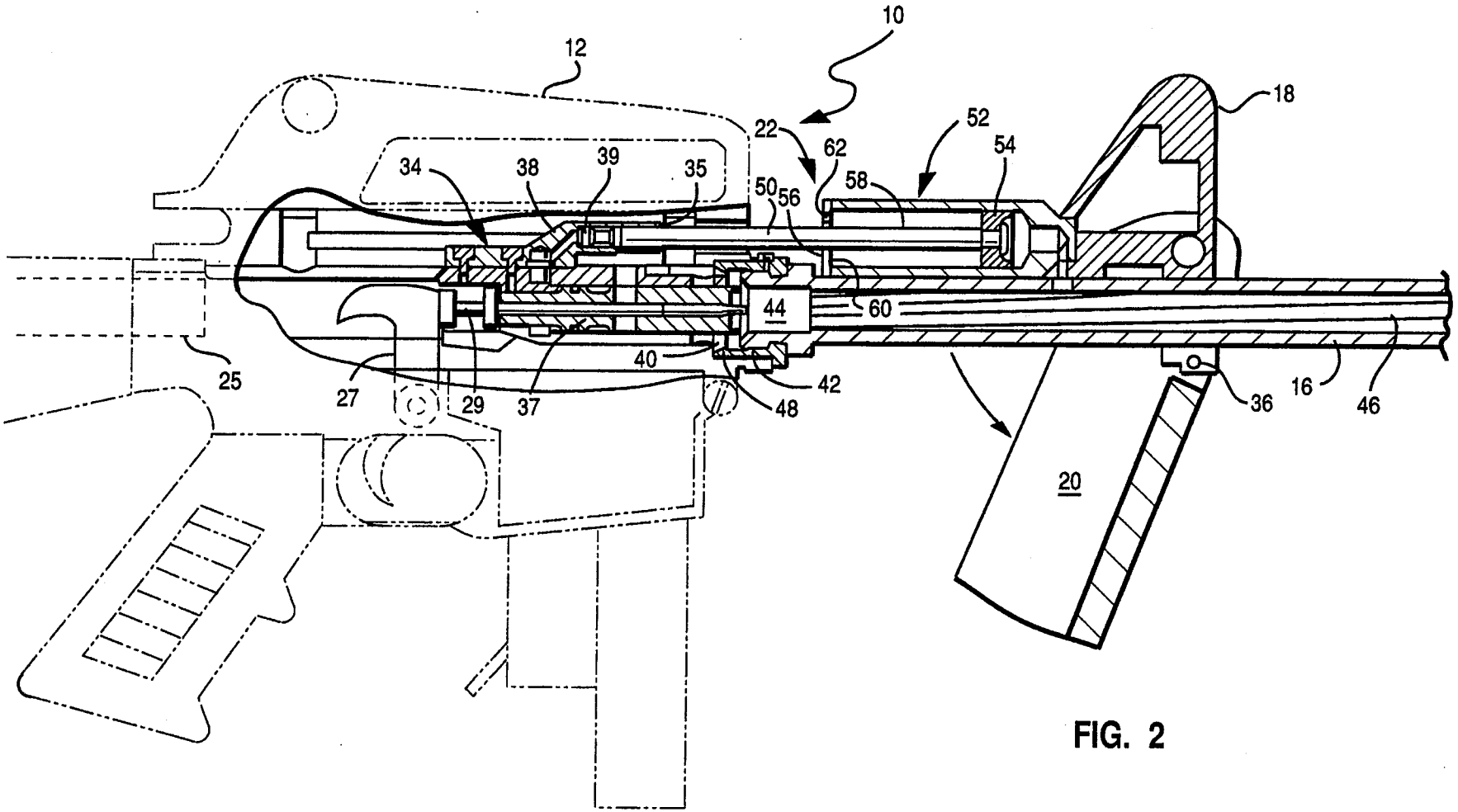
FIGS. 2 and 3 are cross-sectional side views of the gas operating system of the rifle of FIG. 1.
Figure 3:
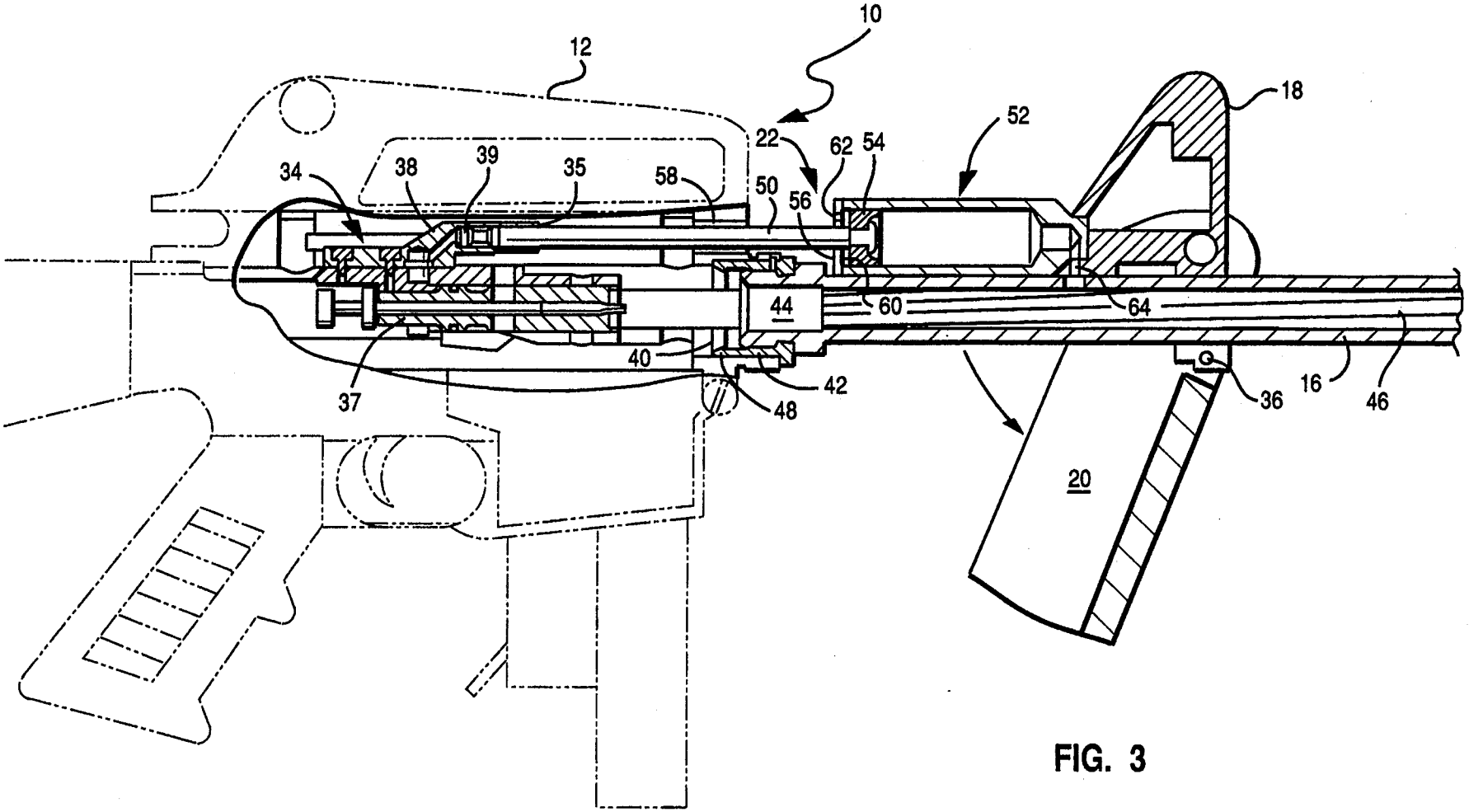

Referring now to FIGS. 2 and 3 which are partial cross-sectional side view schematic drawings, one preferred embodiment of the rifle assembly 10 is disclosed. In FIG. 2, rifle 10 comprises upper receiver 12 shown in cut-away cross-sectional view, to which is threadably attached barrel assembly 16, and a bolt carrier 37, carrying a bolt 40 therein slidably mounted in receiver 12 and having affixed at the top thereof gas key 38. Bolt carrier 37 may be of the conventional M16 type, but bolt 40 has been modified in the locking-lug area as shown in greater detail in FIG. 4 and further described hereinbelow. Also, gas key 38 has been modified by the addition of a hardened metallic insert 39 permanently secured in the inner end of gas tube 35, and by a pin which has been placed in tight-fitting engagement in the conventional gas passage of gas key 38. This steel pin (not shown) extends downwardly into the conventional gas passage of the bolt carrier 37 and serves a dual function. Its first function is to seal off the gas passages of the conventional M16 rifle which pass through the gas key 38 and the bolt carrier 37. The second function is to provide additional strength in the mounting arrangement of the key 38 on the bolt carrier. This additional mounting arrangement supplements the normal mounting which uses two threaded screws between the key and the bolt carrier.

Barrel 16 has a breech 42 adapted for locking engagement with bolt 40. A cartridge chamber 44 is formed in breech 42 adapted to receive a standard short pistol cartridge such as a 0.45 ACP, a 0.40 S&W, or a 10 mm. Chamber 44 communicates with rifle bore 46 which is conventionally rifled by button rifling or broach-cut rifling. The breech 42 has locking lugs 48 formed therein to engage with corresponding locking lugs located on the end of bolt 40. The construction of barrel 16 is of a conventional M16 type except for the unusual chambering (44) and an additional difference in that gas passage 64 formed in barrel 16 is considerably larger than conventional gas passages due to the requirement of a larger volume of gas operating at lower pressures with the aforementioned short pistol cartridges. Whereas a conventional gas port in the M16 barrel would be in the range of 0.10–0.15" in diameter, the present invention utilizes a gas port which is considerably larger, i.e. in the range of about 0.18–0.25" in diameter.

A gas system 22 is located in permanently affixed relationship to front sight assembly 18 by means such as welding. Gas system 22 consists essentially of a cylindrical gas cylinder 52 fixedly mounted to site base 18 and containing therein a slidable piston 54 having a dished gas pressure face and being fixedly secured to a slidable piston rod 50. Piston rod 50 extends concentrically down gas cylinder 52 and slidably engages a cylinder nut 56 which is threadably engaged in the left-most end of cylinder 52. Gas cylinder 52 is preferably made of a hard structural material such as steel or stainless steel. Likewise, piston 54 is made of a similar metal such as steel or stainless steel and is finished in a smooth polished exterior for a relatively snug-fitting engagement in cylinder 52, sufficient to allow the piston to slide without extreme friction, but tight enough to provide a relatively good gas-tight seal of the piston against the cylinder wall.

Cylinder 52 is closed at the opposite end by a cylinder nut 56 which may be made of any structural material such as steel, stainless steel, brass, or aluminum. In one preferred embodiment, cylinder 52, piston 54, and piston rod 50 were all formed of stainless steel, and cylinder nut 56 was made of brass to provide a relatively soft bushing-type bearing surface for sliding piston rod 50. Also, in the preferred embodiment cylinder 52 was formed having an outer diameter of approximately $\frac{3}{4}$ inch and an inner diameter of about $\frac{5}{8}$ inch. This results in a wall thickness of approximately 1/16 inch for the cylinder. The piston is also of similar diameter, i.e. about $\frac{5}{8}$ inch in outer diameter for a snug-fitting relationship in the cylinder.

The length of cylinder 52 varies depending upon the amount of stroke needed to completely cycle the bolt carrier and bolt assembly 37 backward in the receiver sufficiently to eject a fired cartridge and to load a new unfired cartridge into chamber 44. In one preferred embodiment of the invention, cylinder 52 was approximately $2\frac{1}{2}$ inches in total length with a piston stroke area of about 2 inches internally and the remainder area being dead space and threaded portion for receiving cylinder nut 56. In this same preferred embodiment, gas piston 54 had a total axial length of about 5/16 inch and a hemispherical dished face about ⅛ inch deep, with the piston rod 50 having a total length of about 4½ inches. Gas cylinder 52, piston 54, and rod 50 are arranged to lie approximately parallel to barrel bore 46 and directly above barrel 16 such that piston rod 50 passes through an opening 58 formed in upper receiver 12. Rod 50 extends through opening 58 and engages in passage 35 in abutting relationship with hardened metallic pad 39, which has been molded, staked, swaged, or welded into place in key 38. Preferably, rod 58 is of a hard enough material to prevent scuffing or wear in sliding engagement with the softer metal of cylinder nut 56. Likewise, rod 50 will have a slight clearance through passage 58 so that no contact should occur with the upper receiver 12. Similarly, no contact should occur between rod 50 and key 38 except in the hardened pad area 39.

Figure 4:
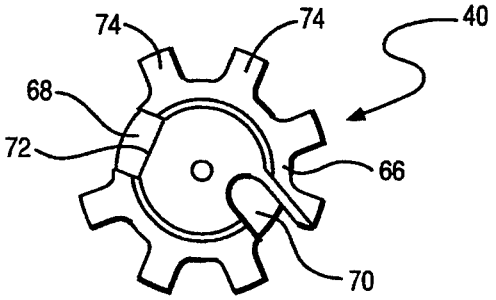
FIG. 4 is an end view of the bolt of the modified M16 rifle of this invention.
Figure 5:
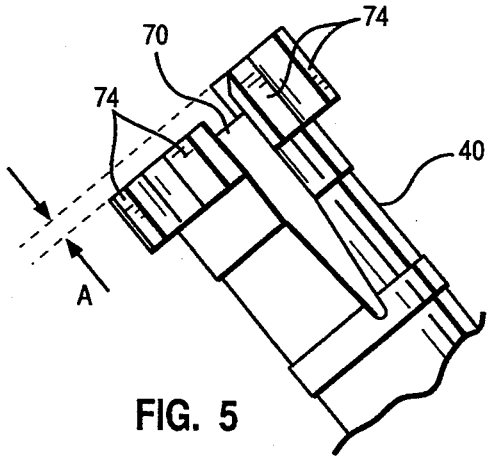
FIGS. 5 and 6 are, respectively, a side view and a cross-sectional side view of the bolt of FIG. 4.
Figure 6:
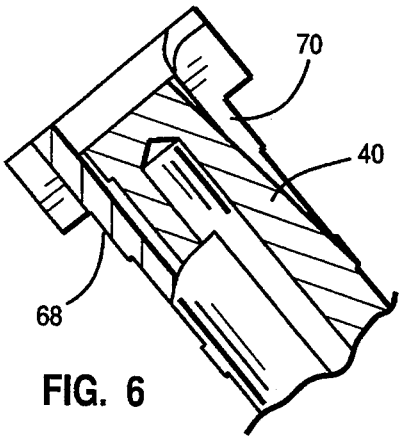

FIGS. 4, 5, and 6 represent the unique lock-up provision of the bolt/breech assembly of the present invention. FIG. 4 is an axial end view of the bolt 40 of the M16 rifle of the present invention. Bolt 40 comprises an assembly having a bolt body 66, a cartridge extractor 68, and a ramped ejector groove 70. Cartridge extractor 68 is of the conventional M16 type which mainly comprises a spring-loaded arm having a cartridge engaging lip 72 extending toward the center of the bolt 40 and adapted to slip over the rim of a metallic cartridge. A biasing spring (not shown) at one end of extractor 68 biases the pivotally mounted extractor radially innerward at lip 72 to maintain lip 72 engaged with the cartridge rim. Concurrently with this biasing, the extractor is also resilient enough to allow the cartridge to be ejected with a flexing of extractor 68 radially outward at the end containing lip 72. The bolt body 40 has formed thereon a plurality of radially extending shoulders or locking lugs 74 adapted to engage with complimentary locking lugs formed in the breech end of the barrel to provide full lock-up of the bolt in the breech.

FIG. 5 is a cross-sectional side view of one embodiment of bolt 40 in which the lower portion of locking lugs 74 have been machined away an amount corresponding to dimension A of the drawing in order to allow the cartridge being fed from the magazine to pass upward into the bolt area and to be engaged with the bolt face. FIG. 5 also illustrates a different view of ejector groove 70. FIG. 6 is a cross-sectional side view of the bolt of FIG. 5 taken at line A—A showing the profile of ejector groove 70. The particular embodiment disclosed in FIG. 5 is particularly advantageous when used in the 0.45 ASC caliber rifle. In a different chambering such as the 0.40 S&W, the locking lugs 74 will all be of the same length and dimension A will be absent.

Figure 7:
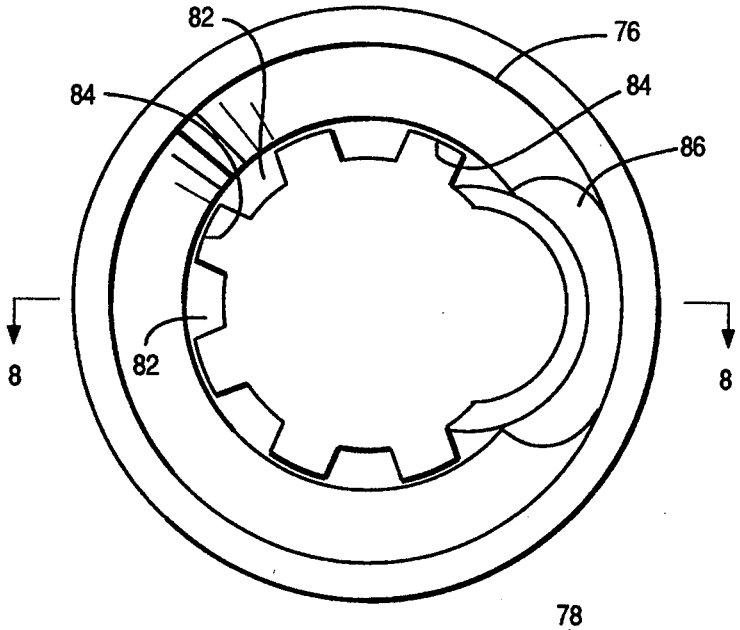
FIGS. 7 and 8 are, respectively, an end view and a cross-sectional side view of the breech assembly of the rifle of FIG. 1.
Figure 8:
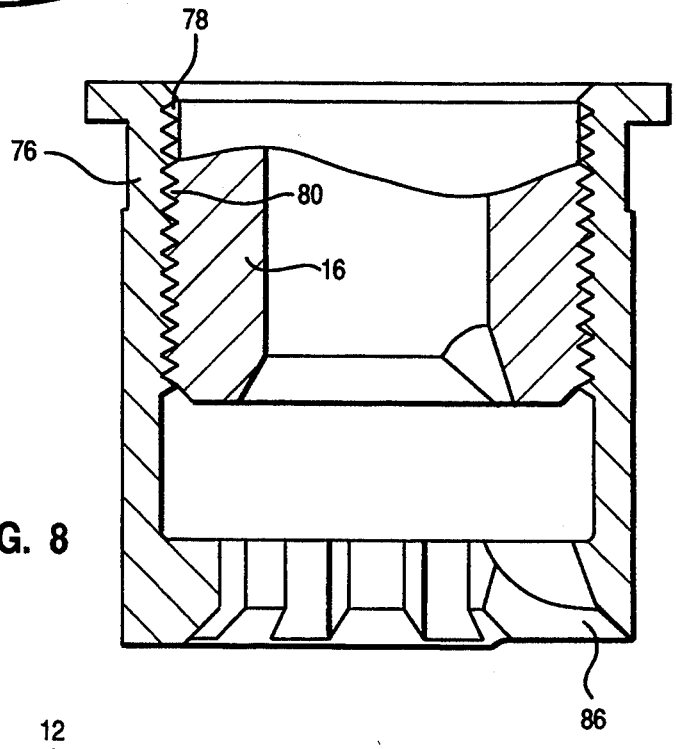

Referring now to FIG. 7, there is disclosed an axial end view of the breech end of the barrel assembly 16 of the rifle. In one preferred embodiment of the invention, the breech end of the barrel assembly is formed as a separate component in the shape of a collar or barrel extension 76, which is threadably attached to the breech end of the barrel 16 by threaded sections 78 formed in barrel extension 76 and complimentary threads 80 formed on the exterior end of barrel 16. Barrel extension 76 has complimentary locking lugs 82 extending radially inward therein adapted to receive in locking relationship the external lugs 74 on bolt 40. Longitudinal grooves 84 separate locking lugs 82 and allow axial sliding movement of lugs 74 on the bolt 40 to slide into engagement with barrel extension 76, whereupon bolt 40 is rotated by the aforementioned and described camming action to rotate bolt lugs 74 circumferentially into locking engagement directly behind barrel extension lugs 82. The aforementioned and described locking action is conventional to the M16 weapon and known to those skilled in the art. The present embodiment of barrel extension 76 is unique though in the fact that a relief 86 has been formed along the lower portion, comprising approximately 30% of the circumference of the barrel extension 76 by removing the locking lugs 82 in this lower portion and cutting into the face of the extension to provide a relief and loading ramp area for easier cartridge insertion into the chamber of the rifle. Relief ramp 86 can be more clearly seen in FIG. 8 which is a cross-sectional side view of the barrel extension.

In typical operation, the rifle 10 as illustrated in FIG. 2 is in the configuration of having a live round (not shown) loaded in the chamber, with the bolt 40 locked into locking lugs 48 of breech 42. During the firing operation of the rifle, chamber 44 would contain a live, unfired cartridge having a metallic case and a metallic bullet pressed into the case. The M16 rifle is fired utilizing conventional trigger, hammer means 27 and firing pin 29 which results in the ignition of the powder charge in the cartridge in chamber 44 and generation of gas pressures which drive the bullet down bore 46. Bore 46 may be of any conventional rifle design having button rifling or broach-cut rifling. During the firing of the cartridge, as previously mentioned, bolt 40 is locked into locking lugs 48 of breech 42 by means of conventional bolt rotation caused by camming action between bolt 40 and bolt carrier 37. The bolt remains locked until the bullet passes gas port 64 cut in the barrel wall and communicating with gas passages in the sight base, and the rightmost end of cylinder 52. These passages communicate gas pressures from bore 46 to the dished face of piston 54. It should be noted that in a conventional M16 rifle gas passage 64 is of a relatively small and easily clogged size, such as about 0.10 inches in diameter.

In the present invention however, gas passage 64 is considerably larger, i.e. in the range of about 0.25 inches, thereby providing larger volumes of gas and much less likelihood of contamination and clogging of the gas port. Also, the large nature of gas passage 64 allows the relatively low pressures of the short pistol cartridges to be communicated rapidly to piston 54, which in turn provides sufficient actuating pressure to move piston 54, rod 50, and bolt carrier 37 backward in the receiver (to the left). This results in a conventional camming of bolt 40 into an unlocked posture in breech 42 and continued rear movement allows backward movement of bolt 40 in the upper receiver 12.

The backward movement of bolt carrier assembly 37 and bolt 40 continues until piston 54 has reached the extreme leftmost point of its travel in cylinder 52 and it bottoms against nut 56. An exhaust vent 62 is formed through the wall of nut 56 to prevent any kind of damping or trapping of atmospheric gases or pressure behind piston 54. Gas vent 62 also allows piston 54 to move backward to the right by allowing the atmospheric pressure to pass into cylinder 52 upon rightward movement of piston 54.

At the end of the piston stroke of piston 54 and rod 50, the rifle assembly will have the configuration shown in FIG. 3 with the piston at its far leftmost point of travel and the bolt assembly 37 likewise at its leftmost point of travel. The approximately 2 inches of stroke allowed by piston 54 in cylinder 52 is sufficient to move the bolt assembly back far enough to eject the relatively short wide pistol cartridges.

In FIG. 3, the piston and piston rod are shown in their leftmost point of travel and the bolt assembly 37 is shown in the open position. Rearward movement of bolt 40 and bolt carrier 37 provides extraction of the fired cartridge case from chamber 44 and ejection of the cartridge case from the rifle through an ejection port formed in the side of the receiver as shown in FIG. 1. The extraction of the fired cartridge is conventional in nature and well known with respect to the M16 type rifle and and therefore is not discussed in any greater detail.

Figure 9:
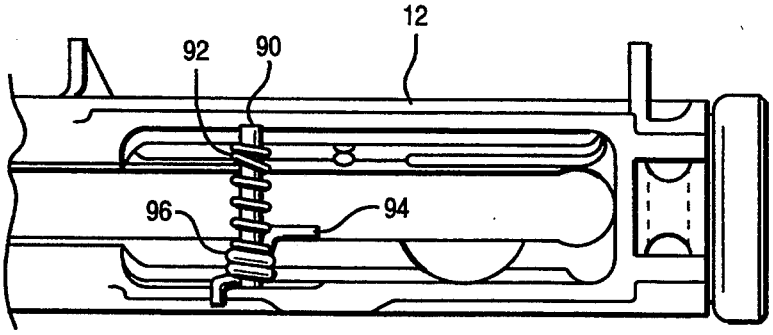
FIG. 9 is a cross-sectional longitudinal view looking upward from below the upper receiver and illustrating the ejector system of the rifle.

Ejection of the spent pistol cartridge, however, cannot be accomplished with the conventional ejector pin found in the bolt face of the M16 rifle due to the short length of the pistol cartridge. The relatively short travel distance of the conventional bolt-mounted M16 ejector pin is insufficient to rotate the short pistol cartridge completely out of the rifle receiver. Therefore, the present invention utilizes a unique ejector system mounted in the upper receiver rather than in the bolt. FIG. 9 is a cross-sectional view of the upper receiver looking upward from directly below the receiver. A transverse rod 90 extends across upper receiver 12 and is secured in the opposite sides thereof. A concentric baising spring 92 is mounted on rod 90 and applies biasing force against an ejector spring rod 94 which extends forwardly of pin 90 and engages in ejector groove 70 of bolt 40 (FIG. 5). When bolt 40 is engaged in breech 42, rod 94 does not extend past the face of bolt 40.

In operation, when bolt 40 cycles backward in response to gas operation of gas assembly 22, rod 94 remains stationary in groove 70. As bolt 40 moves backward in relation to rod 94, rod 94 quickly contacts the face of the extracted cartridge and imparts a combination of axial force and rotational moment to the cartridge which results in springing the extractor 68 outward until the cartridge is free of the bolt face. Rod 94 then continues pushing the cartridge outward, out of the ejection port of the rifle 10.

In addition to the ejection function provided by the ejector assembly 90 and 94, rod 90 also serves a second independent function of preventing the loading of a conventional M16 magazine into the magazine well of lower receiver 14. Only the short narrow magazine of the aforementioned short cartridges can be inserted forward of rod 90. Thus the rifle operator cannot accidentally load a conventional magazine containing the 5.56 mm rifle cartridge of the standard M16 into the rifle of this invention.

Thus, it can be seen that by providing an external cylinder and piston assembly 52, 54, having a relatively large surface area of approximately 3/10 of a square inch, and a stroke of about 2 inches, provides sufficient activating energy to cycle a standard M16 bolt carrier assembly and a sufficient stroke to load, fire, extract, and eject a short wide pistol cartridge such as those previously mentioned herein. As the bolt ends its travel in the receiver, as illustrated in FIG. 3, the piston stroke then bottoms out and any further movement of the bolt is prevented by the action of the buffer and spring assembly of the conventional M16 telescopically located in the buttstock 24.

It should also be mentioned that the conventional forearm assembly of a conventional M16 rifle has been modified to allow the provision of gas cylinder assembly 22 along the top of the barrel between the front site assembly 18 and the upper receiver 12. In one embodiment as discrened in FIGS. 2 and 3, the forearm 20 was formed in a regular U-shaped open-top configuration and hingedly pinned at location 36 to the barrel 16 36 to the barrel 16 such that the handguard assembly is mounted on the rifle by moving it straight upward from directly below the barrel assembly to engage the barrel assembly from below, and encircle the barrel assembly in the aforementioned U-shaped configuration.

FIG. 2 illustrates a cross-sectional side view of the rifle 10 illustrating the shape of the handguard assembly 20 and further showing the U-shaped nature of the handguard and its mounting relationship on the barrel 16. A pin 36 passes through handguard assembly and it is pivotally mounted on the barrel such that it can be pivoted downward in a counterclockwise rotation about pin 36 until it is vertical and can serve as a forward-mounted vertical pistol grip rather than the horizontal handgrip as shown in FIG. 1. A conventional latching means (not shown) is provided for snapping the handguard to the barrel somewhere along the length of the handguard interior, to the left of pin 36. This resilient snapping means may consist of any resilient spring member or friction member which engages the barrel in a removable configuration. The U-shaped open-top nature of handguard 36 allows the handguard to be slipped over the barrel and project upward into a protective relationship outside piston assembly 22.

Thus, the present invention discloses an M16 type rifle which is capable of firing short wide pistol cartridges such as the 45 ACP and the 10 mm, which cartridges provide insufficient internal pressures when fired to operate the normal M16 type of gas operated rifle. The present invention provides this function by utilizing a relatively large piston and cylinder assembly having a large piston area sufficient to provide bolt actuating forces at the relatively low pressures encountered in the typical 0.45 ACP cartridge and the 10 mm and 0.40 S&W cartridges. The piston has a surface diameter of approximately $\frac{5}{8}$ inch and a stroke of about 2 inches which is sufficient to provide operating and actuating forces on the typical bolt carrier assembly of a standard M16 or AR15 type rifle.

The present invention, by eliminating the necessity for gas pressure in the rifle's receiver area, and by plugging the conventional gas passages in the key, the bolt, and the bolt carrier, has eliminated a major source of fouling and resultant jamming in the rifle's operating mechanism. Also, elimination of the gas system in the receiver area has allowed the elimination of the conventional gas piston rings on the bolt inside the bolt carrier, which eliminates a large source of friction and resistance therebetween. This allows an easier cycling of the rifle system and less shock and less wear and tear on the rifle's moving components.

Furthermore, the provision of larger than normal gas passages from the rifle bore to the gas system not only provides sufficient energy to cycle the piston/cylinder assembly 22, but also further prevents clogging of the passages as occurs in conventional weapons having extremely small passages.

Although a specific preferred embodiment of the present invention has been described in the detailed description above, the description is not intended to limit the invention to the particular forms or embodiments disclosed therein since they are to be recognized as illustrative rather than restrictive and it would be obvious to those skilled in the art that the invention is not so limited. For example, whereas the invention is described with respect to the short wide pistol cartridges such as the 45 ACP, 40 S&W, and the 10 mm, it is clear that this invention could also be modified to cover other cartridges such as the 44 magnum and the 41 magnum. Thus, the invention is declared to cover all changes and modifications of the specific example of the invention herein disclosed for the purposes of illustration which do not constitute departure from the spirit and scope of the invention.

The embodiments of the invention in which an exclusive property or privilege is claimed are defined as follows:

1. In an improved M16 rifle having a magazine housing; a trigger and hammer assembly; a handgrip; a buffer assembly; a buttstock assembly; an upper receiver connected to the lower receiver; a barrel attached to said upper receiver and having a rifled bore connected to a cartridge chamber; a breech chamber connected to the cartridge chamber and having a plurality of locking lugs formed therein; a gas port formed in said barrel passing through the wall thereof to said bore; a bolt assembly slidably located in the upper receiver in a forwardly biased relationship by the buffer assembly, axially aligned with the barrel and having a lugged end for close-fitting, locking engagement in the breech chamber; a firing pin slidably located in said bolt and arranged to be activated by the hammer and trigger assembly to fire a cartridge located in the chamber; an ejector assembly located in said rifle arranged to eject cartridges from said bolt assembly upon rearward movement of said bolt; and a gas piston/cylinder assembly mounted on said barrel, having a gas passage communicating with the gas port in the barrel, and a piston mounted on a piston rod and located in a snug-fitting slidable relationship in the gas cylinder, said piston rod extending out of said gas cylinder into the upper receiver in engaging relationship with the bolt assembly; the improvement comprising: said cartridge chamber receiving therein a pistol-caliber cartridge; said gas port being enlarged to a diameter of from 0.180 inch to 0.250 inch in order to allow sufficient gas volume to pass from said rifle bore to said cylinder to move said piston and bolt assembly enough to eject a fired cartridge from said cartridge chamber; and, wherein said ejector assembly comprises a transverse rod extending across the inside of said upper receiver and a concentric biasing spring on said rod and having a projecting end extending forward of said rod into an ejector groove formed in said bolt and arranged to contact a cartridge face when said bolt is moved rearwardly in said upper receiver.

2. The improved M16 of claim 1 wherein said piston diameter is enlarged to about $\frac{5}{8}$ inch diameter to provide sufficient force to move said piston and said bolt assembly backward to eject fired pistol-caliber cartridges from said chamber.

3. The improved M16 rifle of claim 1 further comprising impediment means in the magazine well of the lower receiver arranged to prevent insertion of conventional M16 rifle-cartridge magazines into said well.

4. The improved M16 rifle of claim 1 wherein said ejector assembly further comprises impediment means arranged to prevent insertion of conventional M16 magazines into said well.

5. The improved M16 rifle of claim 1 wherein the lower half of the bolt face has a recessed area formed therein.

6. The improved M16 rifle of claim 1 wherein said breech chamber has a lower section with no locking lugs formed therein and further comprising a relief formed therein to provide a loading ramp area for pistol-caliber cartridges.

7. The improved M16 rifle of claim 1 further comprising an open-top hand guard pivotally mounted to the barrel.

8. The improved M16 rifle of claim 1 further comprising a hardened metallic insert permanently secured to said bolt assembly and arranged to contact said piston rod.

* * * * *